US005462909A

United States Patent [19]

Lakes et al.

[11] Patent Number: 5,462,909

[45] Date of Patent: Oct. 31, 1995

[54] COLOR CODED, THERMALLY IMAGABLE BUSINESS FORM

[75] Inventors: A. Dale Lakes, Dayton; Patrick A. Konkol, Cincinnati, both of Ohio; Edward M. Ribar, Phoenix, Ariz.

[73] Assignee: The Standard Register Company, Dayton, Ohio

[21] Appl. No.: 222,230

[22] Filed: Apr. 4, 1994

[51] Int. Cl.[6] ..... B41M 5/30; B41M 5/34; B41M 5/40

[52] U.S. Cl. ..... 503/201; 427/152; 428/194; 503/204; 503/206

[58] Field of Search ..... 503/204, 206, 503/201; 427/152; 428/194

[56] References Cited

U.S. PATENT DOCUMENTS

| | | | |
|---|---|---|---|
| 4,388,362 | 6/1983 | Iwata et al. | 428/211 |
| 4,523,776 | 6/1985 | Barber | 283/39 |
| 4,627,641 | 12/1986 | Kawaguchi | 283/81 |
| 4,732,410 | 3/1988 | Holbein et al. | 283/67 |
| 4,846,503 | 7/1989 | Strauss | 283/70 |
| 4,939,674 | 7/1990 | Price et al. | 364/523 |
| 4,978,145 | 12/1990 | Mikhail | 283/71 |
| 5,098,130 | 3/1992 | Mikhail | 283/71 |
| 5,198,061 | 3/1993 | Suzuki et al. | 156/234 |

FOREIGN PATENT DOCUMENTS

| | | | |
|---|---|---|---|
| 2154012 | 8/1985 | United Kingdom | 503/226 |

OTHER PUBLICATIONS

J. E. Jones, "Multicolor Easily Printable Bar Code", IBM Technical Bulletin, vol. 14, No. 3, Aug. 1971.

*Primary Examiner*—B. Hamilton Hess

*Attorney, Agent, or Firm*—Killworth, Gottman, Hagan & Schaeff

[57] ABSTRACT

A business form such as a label, tag or the like is provided in which a thermally imagable substrate has on selected portions of its surface a plurality of different colored areas. At least one of the colored areas is obscured by thermally imaging the substrate in a selected area so as to provide color coded information. The colored areas may be preprinted as half-tone screened areas on the substrate in a number of different patterns and arrangements. The form may be printed with both color coded information and variable information in a single printing pass.

13 Claims, 2 Drawing Sheets

COLOR CODED, THERMALLY IMAGABLE BUSINESS FORM

BACKGROUND OF THE INVENTION

This invention relates to a business form such as a label, tag or the like which is provided with color coded information. More particularly, the invention relates to a thermally imagable business form containing on its surface a plurality of different colored areas in which selected colored areas may be obscured by thermal imaging.

In the design and use of business forms, labels, tags, and the like, it is desirable to present information in an organized fashion so that information may be readily assimilated. For example, forms typically use headings or columns to identify different categories of information. Lines, rules, and screened areas are also used to delineate specific areas of information.

Color has also been used on business forms to delineate or differentiate information. For example, multipart forms, with each part being printed on different colored paper, have been in use for many years. The different color of each part of the form designates to whom that part is to be given or sent. Others have used different colored forms, labels or tags to designate, for example, different methods of shipment of packages. As with multi-part forms, however, this method of designation requires that the user maintain an inventory of each different colored form, label, or tag.

To better differentiate categories of information, preprinted screened background areas are often printed in selected colors. One known method used for producing different colors is to apply colored inks during the printing process when the forms are being manufactured. However, such preprinted colored forms are limited in that the arrangement of colors on each form is fixed, which prevents an end user from customizing the form. For example, it may be desirable for an end user to use different colors to provide a color code for each individual form which designates different categories of information.

Color printers can easily perform a color coding function as they can print many different colored images on a substrate at the same time other variable information is added to the form. However, such printers are expensive and slow to operate, thus making them impractical for most automated systems.

It is also possible to achieve colored images from the use of self-contained, carbonless coatings which produce colored images upon the application of pressure such as that from an impact printer. Such coatings are well known, and typically contain dispersed color developers and initially colorless leuco dyes contained in solution within microcapsules. However, in order to provide multiple colors on a form, a separate coating must be applied for each desired color.

Accordingly, there still exists a need in the art for a business form which can be provided with color coded information as well as other printed information by an end user with the use of a single station printer.

SUMMARY OF THE INVENTION

The present invention meets that need by providing a thermally imagable business form such as a label or tag having a plurality of different colored areas on selected portions thereof, selected ones of those colored areas which may be obscured by thermal imaging to provide color coded information.

In accordance with one aspect of the present invention, a business form such as a label or tag is provided comprising a thermally imagable substrate having first and second surfaces. By thermally imagable, it is meant that the substrate contains heat-reactive chemicals on its surface which may be activated by the application of heat such as with the use of a direct thermal printer. Such chemicals may comprise color forming and color developing reactants which may be coated on a substrate. When subjected to heat, the coatings combine to form a visible color such as black. When a thermally imagable substrate passes under the print head of a thermal printer, the coated surface is activated by the heated print elements, and black images or indicia are formed on the surface of the substrate. Examples of thermally imagable substrates may be found in U.S. Pat. Nos. 3,924,049, 4,627,641, and 5,001,104.

Preferably, the first surface of the thermally imagable substrate includes on selected portions thereof a plurality of different colored areas which are different from the thermally imagable color of the substrate. The colored areas are preferably preprinted on the substrate, over the thermally imagable coating.

In a preferred embodiment of the invention, at least one of the colored areas on the substrate is obscured by thermally imaging the substrate in a selected colored area to produce a color-coded tag or label. For example, the substrate may be imaged with the use of a thermal printer which can be programmed by an end user to heat selected colored areas of the substrate, forming a black image on the substrate which obscures the colors not desired. Color coded information can be provided on the substrate by obscuring several colored areas so that only one color remains on the substrate, or by obscuring only one color such that different colored areas remain. In addition, the printer can be programmed to print variable information on other portions of the substrate at the same time the unwanted colors are obscured.

In another embodiment of the invention, the second surface of the substrate is coated with an adhesive so that the substrate can function as an adhesive label or tag. The adhesive may be a permanent or repositionable pressure sensitive adhesive, a hot melt adhesive, or other suitable adhesive. A release liner is preferably adhered to the pressure sensitive adhesive so that the label or tag may be fed through a thermal printer.

In yet another embodiment of the invention, a continuous web is provided for producing a series of thermally imagable business forms such as labels or tags. The continuous web preferably includes first and second major surfaces, with the first surface of the web including on selected portions thereof a plurality of different colored areas which are different from the thermally imagable color of the web. The web may also include on its second surface an adhesive. Where a pressure sensitive adhesive is used, the adhesive is covered by a release liner. The present invention also provides a method of making a color coded business form which comprises the steps of preprinting over the thermal image coating different colored areas on selected portions of the first surface of the substrate which are different from the thermally imagable color of the substrate, and then thermally imaging the substrate in one or more selected areas such that at least one of the colored areas on the substrate is obscured. The colored areas are preferably preprinted on the substrate as half-tone screens which are made up of dots so that the colored areas are more readily obscured when thermally imaged.

The colored areas may be printed on a form, label, tag or the like in a number of different patterns. For example, the colors may be applied only around the peripheral edges of a form, tag, or label. In one embodiment of the invention, the colored areas are preprinted in an alternating side-by-side relationship around the peripheral area of the substrate. By obscuring some colors by thermally imaging selected areas, the periphery can be made to show one or more selected colors remaining. In an alternative embodiment, the outer peripheral area of the substrate is preprinted with a first color, a middle peripheral area adjacent the outer peripheral area is preprinted with a second color, and the inner peripheral area adjacent the middle peripheral area is preprinted with a third color.

Accordingly, it is a feature of the present invention to provide a color coded business form such as a label, tag or the like having a plurality of different colored areas preprinted on selected portions thereof which may be obscured by thermal imaging, leaving other colors unobscured to provide color coded information. Other features and advantages of the invention will be apparent from the following description, the accompanying drawings, and the appended claims.

DETAILED DESCRIPTION OF THE PREFERRED EMBODIMENTS

Figure 1:
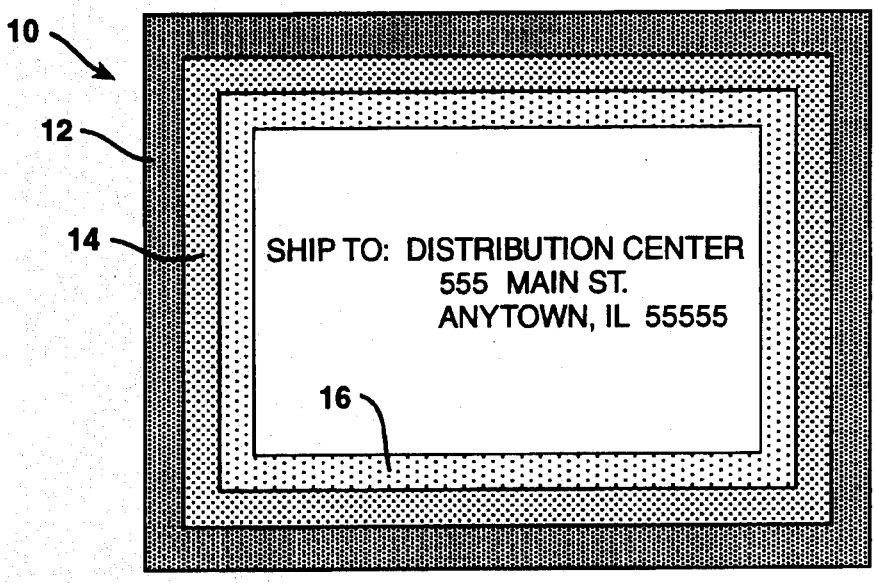
FIG. 1 is a plan view of a thermally imagable business form having different colored areas on selected portions thereof in accordance with the present invention.

The thermally imagable business form of the present invention may include labels, tags, or other documents in which it is desirable to provide color coded information. The substrate preferably comprises direct thermal paper stock such as, for example, 120 LAM, 130 LAM, or 130 NA, commercially available from Ricoh.

The colors on the business form are preprinted onto the thermally imagable substrate preferably as half-tone screens using transparent inks in conventional printing techniques comprised of a series of dots as illustrated in the drawing figures. Although the dots are spaced closely together, a series of voids exists between the dots. By printing the colors as screens rather than printing solid colors, the visual appearance of the colors is maintained while making it easier to obscure the colors by thermal imaging. Many different colors may be preprinted on the business form. The colors may be printed in selected areas which can form blocks of color, or they may be printed in the form of images, symbols, stripes, borders, or the like. An example of a half-tone screen that may be utilized is a screen having 60 lines per inch at 10% area coverage.

With reference to the drawings, it must be appreciated that the use of solid black line drawings on a white surface make illustration of some of the subtleties of our invention relating to different colors difficult by the drawings alone. Reference to the following detailed description of the illustration will make full appreciation of the drawings and our invention possible.

As can be seen in the drawing figures, the preprinted colored areas may be printed on selected portions of the substrate in a number of patterns. It should be appreciated that many different combinations for placement of the colors on a substrate are possible and are within the scope of this invention.

Referring now to FIG. 1, a business form 10 is shown comprising a thermally imagable substrate having first and second major surfaces. The first surface of the sheet includes selected portions 12, 14, and 16 of different colored areas around the periphery of the form. The outer peripheral area 12 of the form is printed with a first color, the middle peripheral area 14 adjacent the outer peripheral area is printed with a second color, and the inner peripheral area 16 adjacent the middle peripheral area is printed with a third color. For example, portion 12 of the label may be a red color, portion 14 may be a blue color, and portion 16 may be a yellow color. A thermal printer may be used to image the form and obscure one or more of the colors so that the remaining color or colors provide the desired color code.

Figure 2:
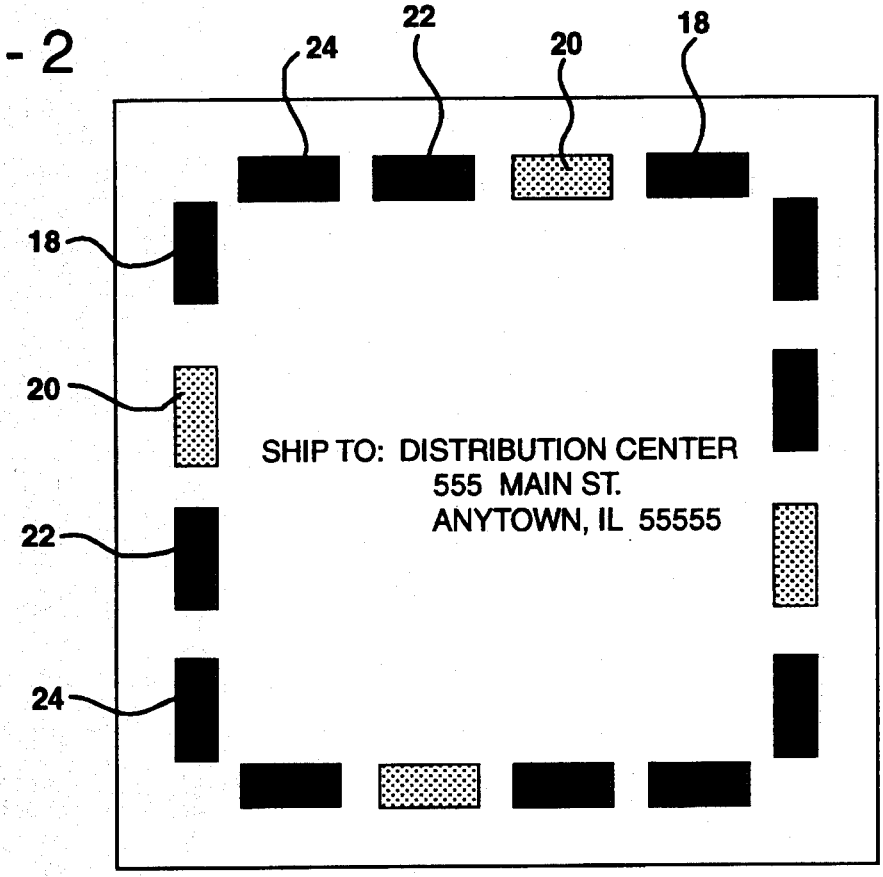
FIG. 2 is a plan view of a label which has been thermally imaged in accordance with another embodiment of the invention.

In an alternative embodiment shown in FIG. 2, the colored areas may be printed in alternating side-by-side relationship about the periphery of a label. For example, block 18 is printed with a first color, block 20 is printed with a second color, block 22 is printed with a third color, and block 24 is printed with a fourth color. Such an arrangement allows an end user to selectively obscure one or more colors around the boundary of the form to provide an indication of how the form is to be processed. As illustrated, the label has been thermally imaged such that colored blocks 18, 22, and 24 are obscured and only colored block 20 remains.

Direct thermal printers currently in use in the art include print heads or print bars with small heated elements which are individually addressable by digital input from a controlling computer. When the thermally imagable substrate is passed under the print heat or print bar of a thermal printer, selected heated elements are activated and heat selected areas on the substrate. When a selected area containing a preprinted colored area is heated, the components of the thermally imagable coating on the substrate melt and combine to form a black color which obscures the colored area. The thermal printer can be programmed to obscure only one color, or to obscure any number of colors. Both printed information and the desired color coding can be completed in a single printing pass.

Thus, by selecting which colored areas are desirable, one can produce a color-coded document which imparts information to a user. For example, the colored areas of a form may be used as an indication of which department in an organization to which the form is to be routed. Additionally, the form may be a tag or label which is attached to an article or package, with the color providing an indication of method of shipment. The possible uses of the invention are many and varied.

In a preferred embodiment, the form includes a pressure sensitive adhesive on its second surface. This is desirable when the form is to be used as a label or tag which is affixed to an article. The adhesive preferably comprises a pressure-sensitive adhesive but may include any suitable adhesive such as water-based, solvent-based, or hot-melt adhesives. The adhesive may be permanent or repositionable. Where a pressure sensitive adhesive is used, a release liner covers the adhesive and protects it until use.

Figure 3:
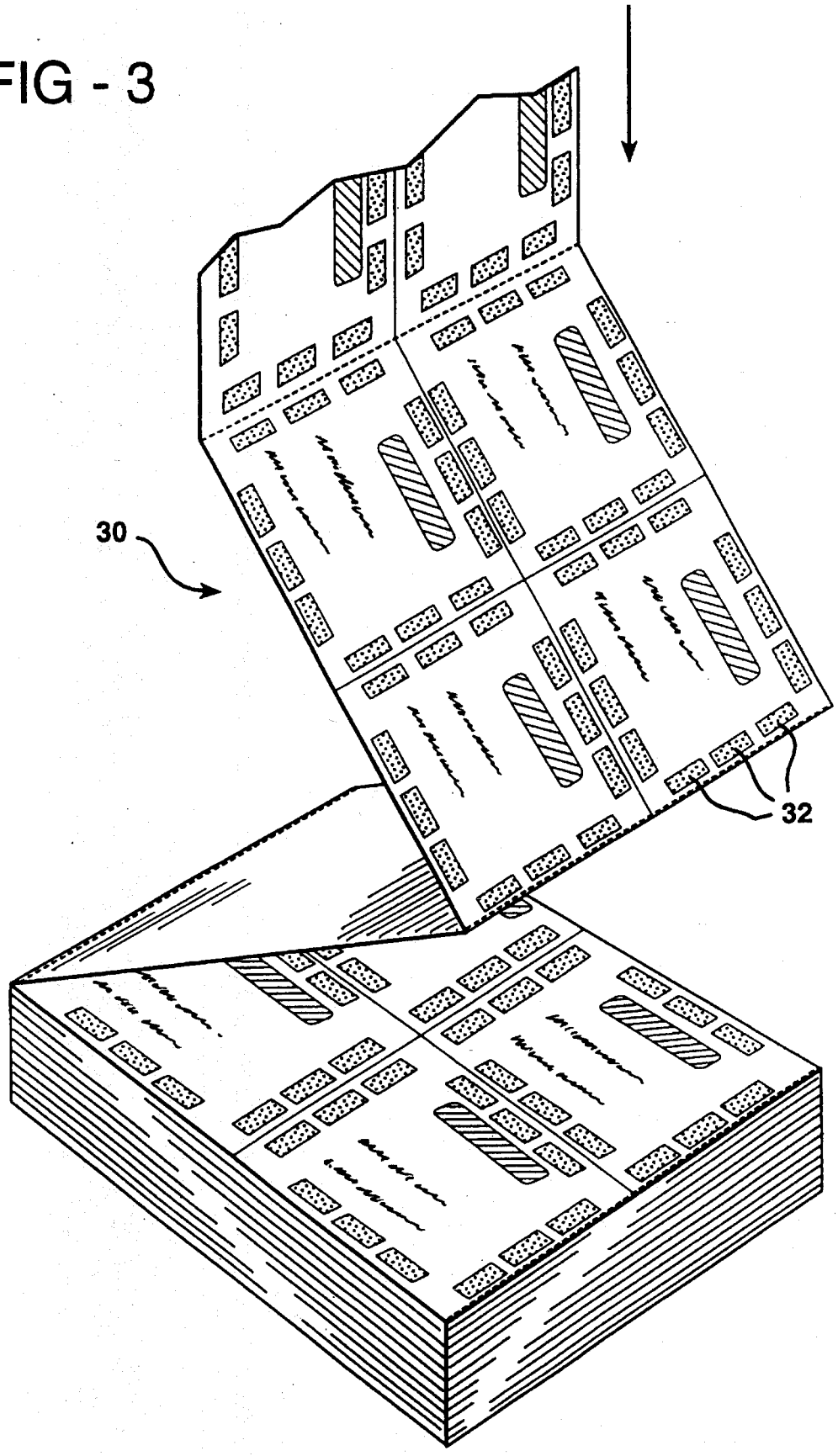
FIG. 3 is a perspective view of a continuous web of labels in accordance with the present invention.

In another embodiment of the invention illustrated in FIG. 3, a continuous web 30 is shown which contains a series of thermally imagagable labels preprinted with different colored areas which may be selectively obscured by thermal imaging. If desired, each label may be preprinted with nonvariable, repetitive information and then preprinted with different colored areas in accordance with the present invention so that the labels can later be imaged to obscure the unwanted colors as well as add variable information.

The invention provides the advantage that a form may be provided with color coded information by an end user instead of using multi-ply labels or forms which require a different color for each ply. The end user can print customized, color-coded forms as needed. Further, the invention has the advantage that both the desired variable printed information as well as the obscuring of selected colored areas may be achieved in a single printing pass through an inexpensive, single-color printer by the end user.

Further, thermal paper stock is low in cost, and the operation of nonimpact, direct thermal printers is less expensive than the operation of impact printers which require ribbon or ink.

The present invention has many potential uses including shipping labels in which selected colored areas may be obscured to designate the method or location of shipment. Other uses for the present invention include airline tickets or event tickets. For example, selected colored areas could be obscured to designate first class or coach seating.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A color coded business form comprising a thermally imagable substrate having first and second major surfaces, said first surface of said substrate having thereon a thermally imagable coating which is activated by heat to form a color, said first surface of said substrate further including on selected portions thereof a plurality of different colored areas which are over said thermally imagable coating and which are of a different color from the color of said thermally imagable coating, whereby selected ones of said different colored areas may be obscured by thermal imaging to provide color coded information.

2. The business form of claim 1 wherein said different colored areas have been preprinted in an alternating side-by-side relationship on the outer peripheral area of said substrate.

3. The business form of claim 1 wherein the outer peripheral area of said substrate has been preprinted with a first color, a middle peripheral area adjacent said outer peripheral area has been preprinted with a second color, and an inner peripheral area adjacent said middle peripheral area has been preprinted with a third color.

4. The business form of claim 1 wherein said second surface of said substrate is coated with a pressure sensitive adhesive.

5. The business form of claim 4 wherein a release liner is adhered to said pressure sensitive adhesive.

6. The business form of claim 1 comprising a continuous web comprising a series of thermally imagable business forms.

7. A method for making a color coded business form comprising the steps of:

providing a thermally imagable substrate having first and second surfaces, said first surface of said substrate having thereon a thermally imagable coating which is activated by heat to form a color, preprinting over said thermally imagable coating different colored areas on selected portions of said first surface of said thermally imagable substrate which are of a different color than the color of said thermally imagable coating;

thermally imaging said substrate in one or more selected areas such that at least one of said different colored areas on said substrate is obscured to provide color coded information.

8. The method of claim 7 wherein said colored areas are preprinted onto said substrate as half-tone screens.

9. The method of claim 7 wherein said colored areas are preprinted in an alternating side-by-side relationship on the outer peripheral area of said substrate.

10. The method of claim 7 wherein the outer peripheral area of said substrate is preprinted with a first color, a middle peripheral area adjacent said outer peripheral area is preprinted with a second color, and an inner peripheral area adjacent said middle peripheral area is preprinted with a third color.

11. The method of claim 7 including the step of printing variable information at the same time said substrate is thermally imaged in one or more selected areas.

12. The method of claim 7 wherein said colored areas are preprinted on said substrate using transparent dye-based inks.

13. A color coded business form comprising a thermally imagable substrate having first and second major surfaces, said first surface of said substrate having thereon a thermally imagable coating which is activated by heat to form a color, said first surface of said substrate further including on selected portions thereof a plurality of different colored areas which are over said thermally imagable coating and which are of a different color from the color of said thermally imagable coating, wherein at least one of said different colored areas has been obscured by thermally imaging said substrate to provide color coded information.

* * * * *